US009905212B1

(12) United States Patent
McDonald et al.

(10) Patent No.: US 9,905,212 B1
(45) Date of Patent: Feb. 27, 2018

(54) BRIDGE WITH PICKUP FOR HYBRID ARCHED TOP GUITAR OR THE LIKE

(71) Applicant: Korg U.S.A., Inc., Novato, CA (US)

(72) Inventors: Robert Douglas McDonald, Petaluma, CA (US); William Eric Kirkland, Lenoir, TN (US)

(73) Assignee: Korg U.S.A., Inc., Melville, NY (US)

( * ) Notice: Subject to any disclaimer, the term of this patent is extended or adjusted under 35 U.S.C. 154(b) by 0 days.

(21) Appl. No.: 15/489,250

(22) Filed: Apr. 17, 2017

Related U.S. Application Data

(60) Provisional application No. 62/460,396, filed on Feb. 17, 2017.

(51) Int. Cl.

| | |
|---|---|
| ***G10H 3/00*** | (2006.01) |
| ***G10H 3/18*** | (2006.01) |
| ***G10D 1/08*** | (2006.01) |
| ***G10D 3/04*** | (2006.01) |
| ***G10H 3/14*** | (2006.01) |

(52) U.S. Cl.
CPC ..... *G10H 3/185* (2013.01); *G10D 1/085* (2013.01); *G10D 3/04* (2013.01); *G10H 3/143* (2013.01)

(58) Field of Classification Search
CPC .... G10H 2220/471; G10H 3/181; G10H 1/32; G10H 2220/511; G10D 3/04
See application file for complete search history.

(56) References Cited

U.S. PATENT DOCUMENTS

| | | | | |
|---|---|---|---|---|
| 5,539,147 | A * | 7/1996 | Hoshino | G10H 3/185 84/723 |
| 6,166,309 | A * | 12/2000 | Hoshino | G10D 3/04 84/298 |
| 2004/0134330 | A1* | 7/2004 | Braun | G10H 3/185 84/298 |
| 2005/0011342 | A1* | 1/2005 | Fishman | G10H 3/143 84/730 |
| 2009/0205477 | A1* | 8/2009 | Stadler | G10D 3/04 84/299 |
| 2012/0180616 | A1* | 7/2012 | Tracy | G10D 3/04 84/307 |
| 2013/0160634 | A1* | 6/2013 | Hosler | G10H 3/185 84/731 |
| 2017/0206866 | A1* | 7/2017 | Xavier | G10D 3/02 |

* cited by examiner

*Primary Examiner* — Marlon Fletcher
(74) *Attorney, Agent, or Firm* — Drinker Biddle & Reath LLP

(57) ABSTRACT

An arched top bridge upper section including a wood top section slotted to accept a string saddle that may be plastic, bone or similar material. The wood section is laminated or affixed to a lower metal section. A slot completely through the wood section exposes a top flat surface of the metal section. A piezo pickup element installed in the slot below a solid or segmented string saddle element is pressed uniformly against the metal section by string pressure on the string saddle to ensure even response on all strings. Transfer of string energy is more efficient than standard all-wood construction, resulting in greater sustain of plucked notes and a broader frequency response. An arch top guitar utilizing this bridge construction has more similar tonal and sustain characteristics to a typical flattop acoustic guitar while consistent contact with the piezo element results in even string-to-string output and response.

15 Claims, 5 Drawing Sheets

FIG. 5A
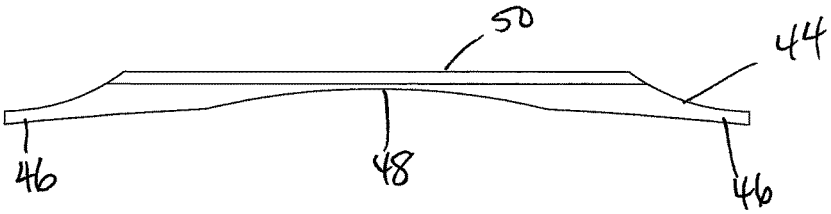
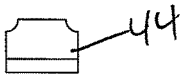
FIG. 5C
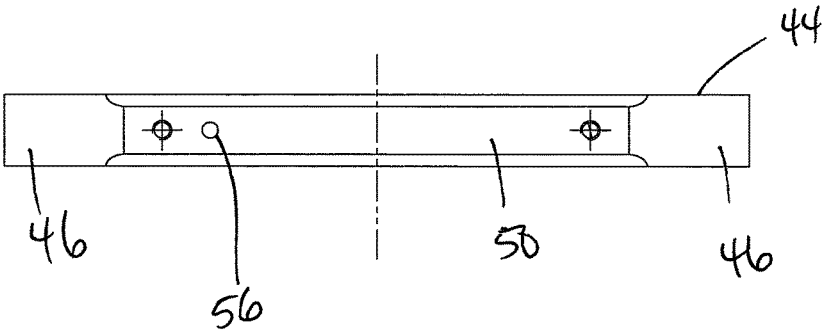
FIG 5B

BRIDGE WITH PICKUP FOR HYBRID ARCHED TOP GUITAR OR THE LIKE

RELATED APPLICATION

This application is related to and claims priority from U.S. Provisional Application 62/460,396, filed on Feb. 17, 2017, the disclosure of which is incorporated herein by reference in its entirety.

FIELD OF THE INVENTION

The invention relates to arched top guitars and, more particularly to a bridge with a pickup for arched top guitar.

BACKGROUND

Stringed musical instruments typically generate sounds of specific pitches by the vibration of stretched strings. In one common arrangement, which is used, for example in guitars, several strings, side by side, are stretched from an anchor near a tail of the guitar body, over a bridge that supports the strings, and up along a fretted neck to an attachment at the head with a device for adjusting the tension of each string. By holding a string down onto one of the frets, a player defines the length of string between the bridge and the chosen fret, and thus chooses the note to be played.

In an acoustic guitar, the vibration of the string, assisted by construction of the guitar body, which is at least partially hollow, causes sound in the air. That sound can then be detected by a microphone and amplified. In an electric guitar, the vibration of the string is converted into an electrical signal by a transducer, and the electrical signal is amplified and then converted into sound, usually by a loudspeaker. The commonest form of transducer is an electromagnetic pickup, in which the vibration of the strings, which are typically at least partially metallic, within a magnetic field induces an electric current in a coil of wire. The amount of current generated is correlated to the sound that is produced. Electric and acoustic guitars sound very different. That is important, because a particular sound may better suit a particular style of music, or a particular musician.

A "hybrid" guitar is a guitar in which the vibration of the strings is converted into an electrical signal by a piezoelectric sensor in the bridge. The piezoelectric sensor may be the only way of producing an output, or may be used in addition to an electromagnetic electric-guitar pickup, or may be mounted on an amplified acoustic guitar. Hybrid guitars tend to produce a sound somewhere between an acoustic guitar and a conventional electric guitar.

The configuration of the instrument body also affects the sound. Arched top and flattop guitars are two well-known guitar constructions. As a function of traditional construction techniques known to those who are versed in the art of building both flattop and arched top acoustic guitars, the arched top guitar's construction uses an arched or carved top plate that is typically braced with only two braces, as the arched structure is sufficient to withstand the downward pressure exerted by the strings on the top through the bridge. This construction creates a strong initial "attack," which is the initial transient response when the string is plucked, that decays rapidly, causing the typical arched top guitar to have a short duration to the length of time that the string sounds, which is commonly called "sustain." Flattop guitar construction uses a non-arched, flat top plate normally significantly braced to withstand the pull of the strings on the guitar's bridge. This construction typically results in an instrument with a less pronounced initial attack than an arched top guitar, but one with significantly more sustain—the plucked note sustains for a longer duration than with an arched top construction.

Many modern guitarists are drawn to the physical and cosmetic attributes of arched top guitars, but are unable to utilize them for live performance or recording as such guitars lack the desired sustain and full range frequency response associated with flattop guitars. These issues are compounded in existing hybrid guitars. Typically, the bridge in a hybrid guitar has a slot in its top surface, which is a "saddle" on which the strings actually rest. The piezoelectric element is located in the bottom of the slot, under the saddle. However, that location can result in inconsistent contact between the top surface of the slot and the underside of the saddle, and thus inconsistent transmission of the vibration from the strings. There is a desire in guitar aficionados to have an instrument with the physical characteristics of an arch top with the sound and response of a flattop guitar, when played both acoustically and amplified.

One remedy that has been attempted to make an arched top guitar respond more similarly to a flattop guitar has been the use of a bridge top section made entirely of metal. That compares with conventional methods of making the base section that contacts the guitar's top, and which often provides an anchor point for a mechanism to adjust the height of the strings relative to the face of the fingerboard, made of metal. Commonly used metals for entirely metal arched top bridge top sections are zinc, aluminum or brass. Using an all-metal bridge top section does not appreciably alter the response of an arched top guitar so as to be more similar to that of a flattop guitar. The resulting guitar tends to sound less warm tonally (lacking in low frequencies) than a typical flattop acoustic guitar, and the sustain of the plucked note is not appreciably extended towards the longer sustain found in typical flattop acoustic guitars.

Another remedy that is common is to install a long piezoelectric pickup strip below a full-length string saddle in a wooden bridge top section, and alter the frequency response electronically using filters and equalization. However, that is not satisfactory, especially with a two-piece adjustable bridge, where the bridge top section is usually mounted to the base section by adjustable posts at both ends, and unsupported in between.

A typical wooden bridge top section suspended between two posts will flex, especially when slotted to hold an acoustic style saddle. That creates problems in two ways. The flexing bridge top section means that the slot can bend or bow under string pressure such that the piezoelectric element no longer being in equal contact across all strings, resulting in differing amplified output for each string and differences in the tone of each string when amplified. The flexible bridge can also absorb certain frequencies of vibration, lessening sustain.

There is still a need for a hybrid guitar bridge that contributes tonally to the sound of an arched top guitar to give it sound characteristics more similar to an acoustic guitar of flattop construction, and for a hybrid guitar bridge with more consistent string-to-string output when using a piezoelectric pickup element that is sandwiched between the string saddle and the bottom of the saddle slot for amplification purposes.

SUMMARY OF THE INVENTION

In one aspect, there is provided an arched top style bridge upper section consisting of a wood top element that is slotted to accept a string saddle that may be made from plastic, bone or any similar material. The upper wooden bridge section is laminated or affixed with screws, pins or any other connecting element, to a lower machined or cast metal section. The top wooden section contains a slot that is routed completely through the wood section to expose the top flat surface of the lower metal part. A piezo pickup element is installed below a solid or segmented string saddle element so that the piezo element is pressed uniformly against the lower metal section by the downward force of string pressure on the string saddle to ensure even response on all strings.

The string pressure forcing the saddle element against the piezo pickup element and, in turn, against the metal lower section of the bridge top section, enhances the transfer of string energy more efficiently than standard all-wood arch top guitar bridge construction, resulting in greater sustain of plucked notes and a broader frequency response, when compared to standard all-wood arch top bridge construction or the use of a solid metal bridge top section. The result is that an arch top guitar utilizing the hybrid bridge construction will have more similar tonal and sustain characteristics to a typical flattop acoustic guitar while also ensuring consistent contact with a piezo element sandwiched between the saddle and lower metal bridge section resulting in even string-to-string output and response.

The aluminum bridge section of the invention adds rigidity, ensuring even response from the piezo pickup, and allowing more of the string's natural tone and sustain. The wooden top section of the invention, due to the nature of wood as a light, porous material, maintains tonal warmth and helps smooth any harsh overtones that the metal bridge section may impart.

The unique combination of elements in this invention serve to allow arched top guitars to more accurately emulate the tonal and sustain characteristics of the typical flattop guitar while solving inconsistency issues commonly found when a piezo pickup system is used in the usual manner in a standard arched top guitar bridge.

In another aspect, there is provided a bridge for a stringed musical instrument, comprising a lower element of a first material, an upper element of a second material that is less dense and less rigid than the first material secured to an upper surface of the lower element, the upper element having a slot through it, a piezoelectric transducer mounted on the lower element within the slot, and a saddle within the slot, operatively engaging the piezoelectric transducer and projecting from the slot through an upper surface of the upper element for receiving at least one string of the musical instrument.

The first material may be metal, preferably aluminum, and the second material may be wood.

The bridge may be elongated, with the slot, saddle, and piezoelectric transducer extending in a lengthwise direction of the bridge, for receiving a plurality of strings of musical instrument, the strings extending in a common direction, with the lengthwise direction of the bridge transverse to the common direction of the strings.

The bridge lower element may then be mounted on a bridge base by adjustable posts at two opposite ends of the bridge.

In a further aspect there is provided a stringed musical instrument equipped with a bridge as mentioned, with one or more strings of the musical instrument stretched over the bridge saddle, and with an electrical output from the piezoelectric transducer to an exterior of the musical instrument.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

FIG. 5A is a side elevation view of the base of the bridge of FIG. 2.

FIG. 5B is a top plan view of the base of the bridge of FIG. 2.

FIG. 5C is an end view of the base of the bridge of FIG. 2.

DETAILED DESCRIPTION

Figure 1:
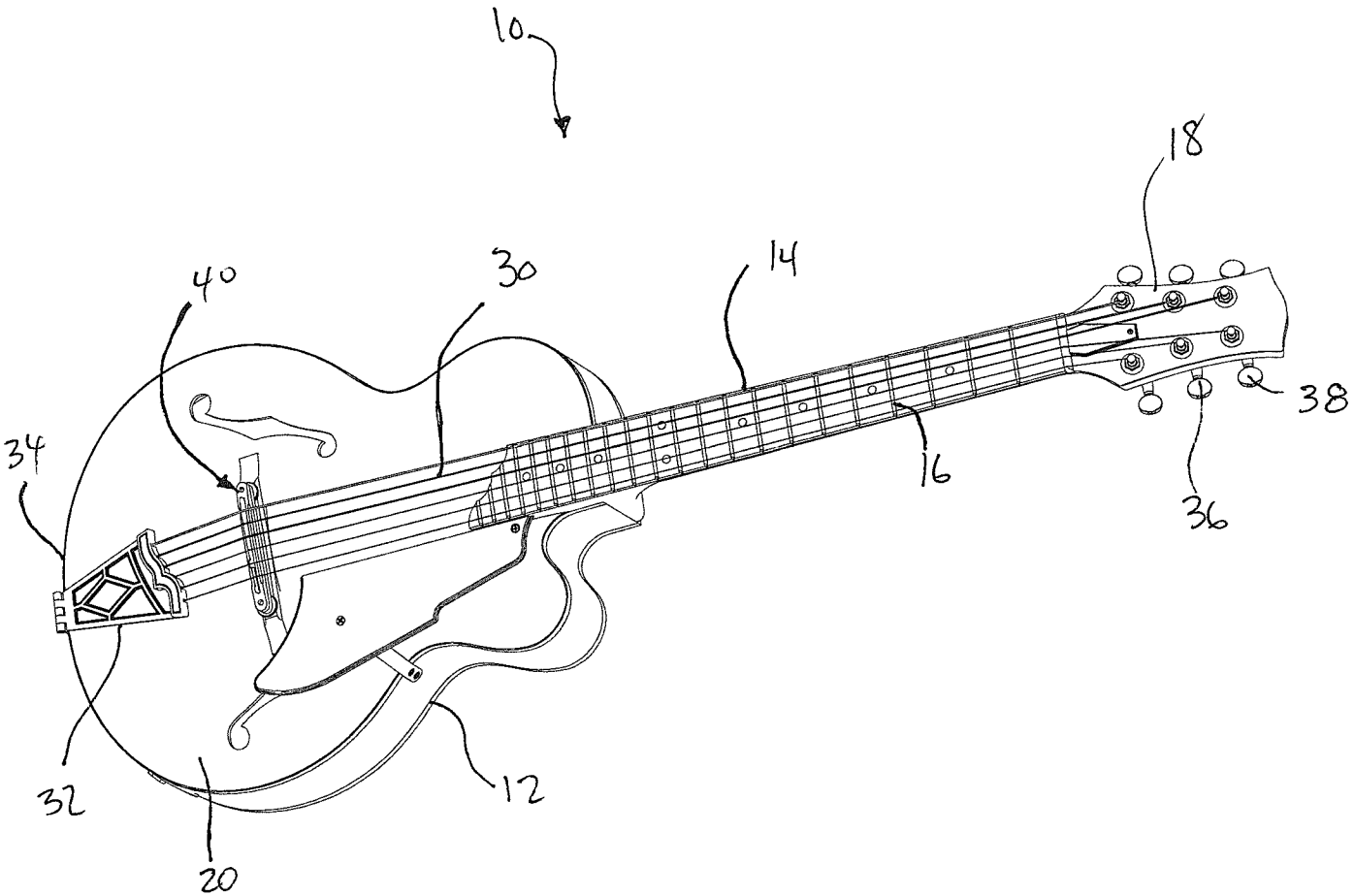
FIG. 1 is a perspective view of a representative arched top guitar.

Referring to the drawings, and initially to FIG. 1, a guitar indicated generally by the reference numeral 10 has a body 12, a neck 14 with frets 16, and a headstock 18. The body 12 typically consists of a carved or formed arched top plate 20, a flat or arched back plate (not shown), curved sides 22 that may be made from either solid or plywood wood material and a provision at the upper bout end of the body to affix the neck 14. The top plate 20 is typically braced with two braces (not shown). The downward pressure exerted by the strings 30 on the top plate 20 through a bridge indicated generally by the reference numeral 40 is supported partly by the braces, and partly by the arched structure of the top plate. The construction of the body 12 may be conventional, and in the interests of conciseness is not further described.

Several strings 30 are attached to an anchorage at a tailpiece 32 near a tail end 34 of the body 12, and extend over the bridge 40 and up the neck 14 to the headstock 18, where they are attached to rotatable pegs 36 of a tuning machine 38. The tension of each string 30 can be adjusted in the usual way by rotating the respective peg 36 to wind string onto or off the peg, thereby increasing and decreasing tension, respectively.

Figure 2:
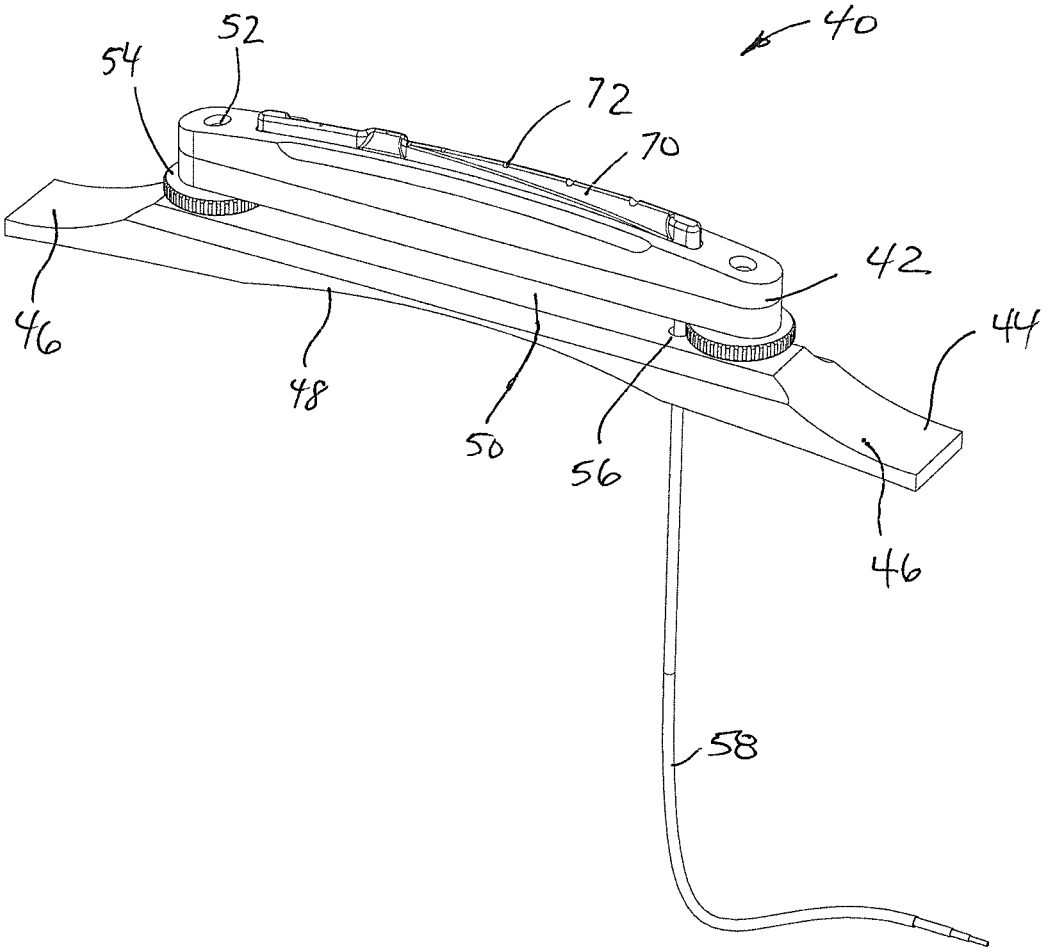
FIG. 2 is a perspective view of a bridge according to the present invention for use with a guitar of FIG. 1.
Figure 3:
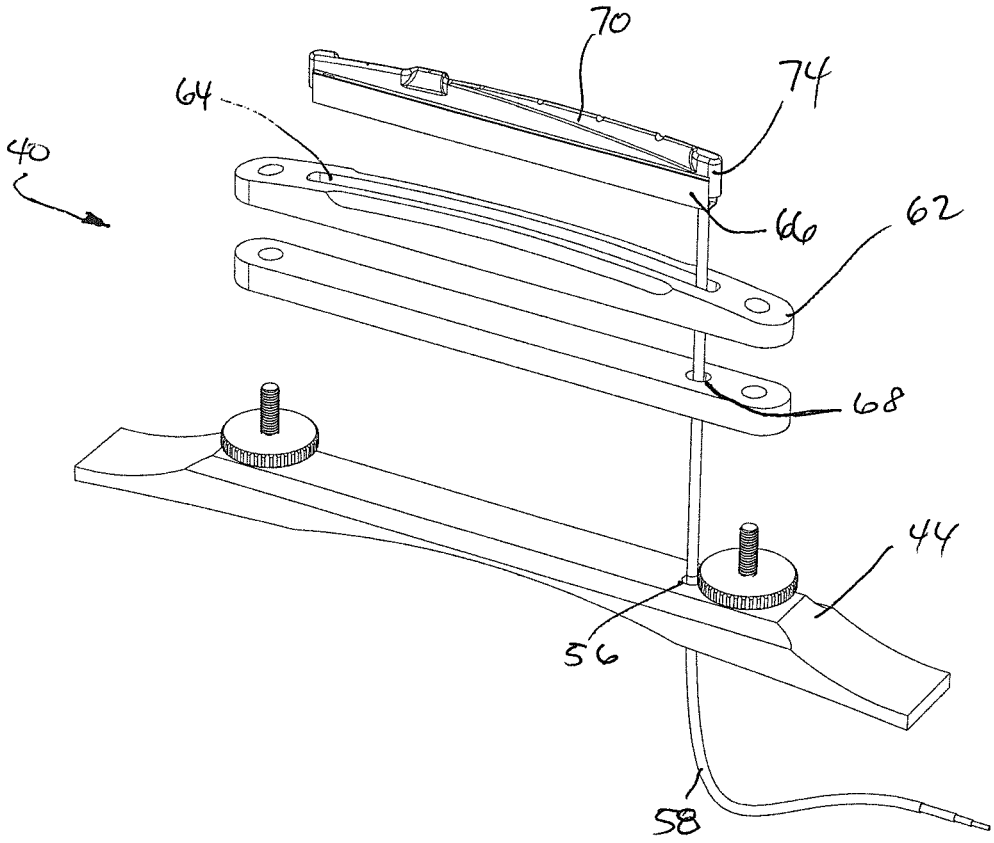
FIG. 3 is an exploded view of the bridge of FIG. 2.

Referring now also to FIGS. 2 and 3, the bridge 40 has a top 42 and a base 44. The base 44 has two feet 46, one at each end, that rest on the guitar body 12 and may be attached to the guitar body in any convenient manner. The base 44 also includes a middle portion 48 that is concave so that it does not contact the guitar body. The bridge base 44 has a flat upper surface 50, and two posts 52 are screw-threaded into holes in the bridge base 44. Two thumbwheels 54 are threaded onto the posts 52, and the bridge top 42 rests on the thumbwheels, so that by rotating the thumbwheels 54, the bridge top 42 can be raised away from the bridge base 44, against the tension in the strings 30, or lowered towards the bridge base 44. This adjustment allows a user to alter the height of the strings 42 in relation to the fingerboard, to select the amount of pressure (called "action") the player prefers to press the string down to the fret 16 to sound a note.

A hole 56 near one end of the bridge base upper surface 50 allows an electrical output wire 58 from the bridge top 42 to be led down into the body 12 of the guitar.

Figure 4A:
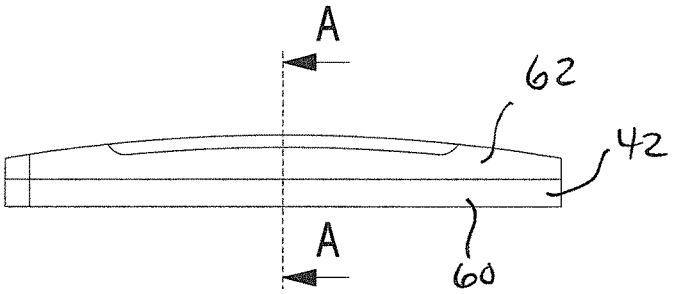
FIG. 4A is a side elevation view of the top of the bridge of FIG. 2.
Figure 4C:
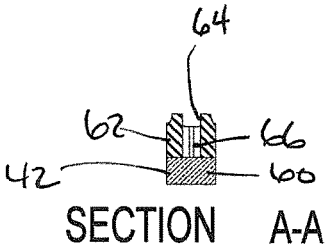
FIG. 4C is a cross-section through the top of the bridge, taken along the line A-A of FIG. 4A.
Figure 4B:
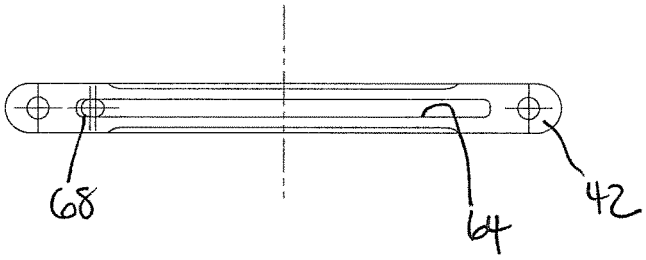
FIG. 4B is a top plan view of the top of the bridge of FIG. 2.

Referring now also to FIGS. 4A-4C, the bridge top 42 comprises at least two pieces, a lower element or saddle support 60 of metal, which in this embodiment is aluminum, and an upper element or cap 62 of wood. The wood may be rosewood or ebony, which are used in conventional arch top guitar bridge construction, though other hardwood material is sufficient. The upper element 62 has a slot 64 extending for most of its length. The slot 64 opens through from the lower element 60 to the upper surface of the upper element 62. A piezoelectric element 66 is positioned in the bottom of the slot 64, in contact with the aluminum lower element 60. The piezoelectric element 66 may be of a sort commercially available for piezoelectric bridge pickups of hybrid guitars, and in the interests of conciseness is not further described here. The slot 64 is dimensioned to receive the piezoelectric element 66 snugly. The piezoelectric element 66 is held into the slot by the tension of the strings 30 pressing on the top of the piezoelectric element, and adhesives or other fastenings are not typically necessary although optionally could be added.

At one end of the slot 64, there is a hole 68 formed through the lower element 60, preferably aligned with the hole 56 in the bridge base 44, for the output lead 58 from the piezoelectric element 66 to extend through. The lead may pass through the guitar body 12 to an external amplifier, or may be connected to a preamplifier or control mounted in or on the guitar body 12. All such circuitry is conventional and, therefore, no further description is necessary.

A saddle 70 is mounted within the slot 64, on top of the piezoelectric element 66. The saddle 70 is held in place by the downward pressure exerted on it by the tension of the strings 30. As may be seen in FIG. 2, the saddle 70 may have notches 72 for individual strings 30. The ends of the saddle 70 are shaped as shown at 74 to allow the saddle to automatically position itself properly in the slot 64. That is a common feature of what are called "compensated saddles," which are molded in such a way as to allow the different string diameters to play in tune up and down the fingerboard by "compensating" for the differing string diameters.

In use, the bridge 40 is mounted on the guitar body 12 in the same way as a conventional bridge, the strings 30 are stretched over the bridge, and the guitar may be tuned and played in the conventional manner. The rigidity provided by the aluminum lower element 60 both improves the support for, and thus the reliability of, the piezoelectric element 66 and provides a channel for vibration from the strings 30 to the guitar body 12 and from the guitar body 12 to the piezoelectric element 66. The softer, lighter, and more absorbent material of the wooden upper element 62 increases the tonal warmth and smooths harsh overtones by preferentially absorbing higher frequencies.

Although an example of a six-stringed guitar is shown in the drawings, those skilled in the art will understand how the teachings of the present application may be applied to other stringed musical instruments.

Aluminum is mentioned as the material for the bridge lower element 60, and hardwood is mentioned as the material for the bridge upper element 62, because they have satisfactory and well understood mechanical properties, are easy to machine, and are reasonably economical. However, for the bridge lower element 60, other metals such as steel or brass may be used. For the bridge upper element 62, other moderately stiff and moderately absorbent materials may be suitable.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The invention claimed is:

1. A bridge assembly for a stringed musical instrument, comprising:

a bridge having an upper element and lower element;

the lower element having a length with an upper surface and a bottom surface, the lower element comprising a first material;

the upper element having a length with an upper surface and a bottom surface, the upper element comprising a second material that is less dense and less rigid than the first material, the length of the upper element being less than the length of the lower element, the upper element secured to the lower element such that the bottom surface of the upper element is in contact with and extends along the upper surface of the lower element, the upper element having an elongated slot extending through it from the bottom surface of the upper element to the upper surface of the upper element so as to form a passage from the upper surface of the upper element to the upper surface of the lower element;

a transducer mounted on the upper surface of the lower element within the slot; and a saddle within the slot, operatively engaging the transducer and projecting from the slot through the upper surface of the upper element for receiving at least one string of the musical instrument.

2. The bridge assembly of claim 1, wherein the first material s metal.

3. The bridge assembly of claim 2, wherein the metal is aluminum.

4. The bridge assembly of claim 2, wherein the second material is wood.

5. The bridge assembly of claim 1, wherein the bridge is elongated, and wherein the slot, the saddle, and the transducer extend in a lengthwise direction of the bridge, for receiving a plurality of strings of the musical instrument, wherein the strings extend in a common direction, and the lengthwise direction of the bridge is transverse to the common direction of the strings.

6. The bridge assembly of claim 1, wherein the lower element is mounted on a bridge base by adjustable posts at two opposite ends of the bridge.

7. The bridge assembly of claim 6, wherein the bridge base has a lower surface that is concave, for mounting on an arched top of the musical instrument.

8. A stringed musical instrument comprising:

a bridge assembly according to claim 1, one or more strings of the musical instrument stretched over the bridge saddle; and an electrical output from the piezoelectric transducer to an exterior of the musical instrument.

9. The instrument of claim 8, which is an arched top guitar.

10. The instrument of claim 8, wherein:

the one or more strings are a plurality of strings extending in a common direction;

the bridge is elongated, and the slot, the saddle, and the transducer extend in a lengthwise direction of the bridge;

the bridge is mounted on the musical instrument with the lengthwise direction of the bridge transverse to the common direction of the strings; and the plurality of strings are stretched over the bridge saddle.

11. A guitar bridge assembly for an arched top guitar comprising:

an arched top style bridge upper section consisting essentially of a wood top element with an upper surface and a bottom surface;

wherein the upper wooden bridge section is attached to a lower metal section, the lower section having a top flat surface and a bottom surface, the bottom surface of the upper section positioned on top of and in contact with the top flat surface of the lower section;

wherein the upper wooden section contains a slot that is routed completely through the wood section to expose a top flat surface of the lower metal section;

a string saddle positioned within the slot and projecting above the upper surface of the supper section;

a piezo pickup element that is installed below the saddle element in the slot so that the piezo element is pressed uniformly against the top surface of the lower metal section by a downward force of string pressure on the string saddle to ensure even response on all strings;

wherein the string pressure forcing the saddle element against the piezo pickup element and in turn against the metal lower section of the bridge top section, enhances transfer of string energy more efficiently than a standard all-wood arch top guitar bridge construction, resulting in greater sustain of plucked notes and a broader frequency response, when compared to standard all-wood arched top bridge construction or the use of a solid metal bridge top section;

whereby an arched top guitar utilizing the hybrid bridge construction will have more similar tonal and sustain characteristics to a typical flattop acoustic guitar than to a standard arch top guitar while also ensuring consistent contact with the piezo element sandwiched between the saddle and lower metal bridge section resulting in even string-to-string output and response.

12. The bridge assembly claim 11, wherein the string saddle is selected from the group consisting of plastic and bone.

13. The bridge assembly of claim 11, wherein the upper wooden bridge section is attached to the lower section by being laminated or affixed with screws, pins or other mechanical connecting element or elements.

14. The bridge assembly of claim 11, wherein the lower metal section is machined or cast.

15. The bridge assembly of claim 11, wherein the string saddle element is solid or segmented.

* * * * *